US006076468A

United States Patent [19]

DiGiacomo et al.

[11] Patent Number: 6,076,468

[45] Date of Patent: Jun. 20, 2000

[54] SOLID PROPELLANT/WATER TYPE HYBRID GAS GENERATOR

[75] Inventors: Michael DiGiacomo, Warrenton; Robert S. Scheffee, Lorton, both of Va.

[73] Assignee: Atlantic Research Corporation, Gainesville, Va.

[21] Appl. No.: 09/048,100

[22] Filed: Mar. 26, 1998

[51] Int. Cl.[7] ..... C06D 5/00

[52] U.S. Cl. ..... 102/530; 280/737; 280/741

[58] Field of Search ..... 102/530, 531, 102/704; 169/12, 84; 280/736, 737, 740, 741

[56] References Cited

U.S. PATENT DOCUMENTS

| | | | |
|---|---|---|---|
| 1,913,015 | 6/1933 | Vodoz | 102/704 |
| 2,740,356 | 4/1956 | Millns | 102/531 |
| 3,649,045 | 3/1972 | Smith et al. | 280/150 |
| 3,785,149 | 1/1974 | Timmerman | 60/205 |
| 3,785,674 | 1/1974 | Poole et al. | 280/150 |
| 3,810,655 | 5/1974 | Pracher | 102/531 |
| 3,862,866 | 1/1975 | Timmerman et al. | 159/21 |
| 3,880,447 | 4/1975 | Thorn et al. | 280/150 |
| 4,034,497 | 7/1977 | Yanda | 102/530 |
| 5,257,818 | 11/1993 | Steffens, Jr. | 280/736 |
| 5,423,384 | 6/1995 | Galbraith et al. | 169/12 |
| 5,449,041 | 9/1995 | Galbraith | 169/11 |
| 5,465,795 | 11/1995 | Galbraith et al. | 169/11 |
| 5,501,284 | 3/1996 | Clodfelter et al. | 169/54 |
| 5,609,210 | 3/1997 | Galbraith et al. | 169/26 |
| 5,613,562 | 3/1997 | Galbraith et al. | 169/12 |
| 5,639,117 | 6/1997 | Mandzy et al. | 102/530 |
| 5,660,236 | 8/1997 | Sears et al. | 169/84 |
| 5,762,368 | 9/1998 | Faigle et al. | 280/741 |
| 5,836,607 | 11/1998 | Wallner | 280/741 |
| 5,913,537 | 6/1999 | Goetz | 280/741 |

*Primary Examiner*—Harold J. Tudor
*Attorney, Agent, or Firm*—Nixon & Vanderhye P.C.

[57] ABSTRACT

In order to fill an inflatable safety restraint device such as an air bag, a relatively small pyrotechnic charge is used to pressurize a chamber of water or other suitable liquid and force the liquid out of the chamber and through a conduit in a manner wherein it is caused to intimately mix and atomize in a high speed stream of gas resulting from the combustion of the pyrotechnic charge. The heat of the combustion gas is absorbed by the liquid which is then converted into a large volume. The vaporized liquid and combustion gas is used to inflate the air bag with an essentially non-toxic, low temperature, low particulate atmosphere. The resulting combustion gas and liquid mixture may also be used to extinguish a fire.

16 Claims, 2 Drawing Sheets

SOLID PROPELLANT/WATER TYPE HYBRID GAS GENERATOR

BACKGROUND OF THE INVENTION

1. Field of the Invention

The present invention relates generally to a gas generating device and more specifically to a gas generating device which mixes water with the hot gaseous combustion products of a solid propellant.

2. Description of the Related Art

Various gas generating arrangements have been proposed for the purposes of inflating a safety restraint device such as an air bag. However, many of these arrangements have simply released the hot combustion products into the inflatable device with very little modification other than screening to remove particulate matter.

In order to modify the gaseous products which are generated by the combustion of a solid propellant such as sodium azide mixed with an oxidizer such as potassium perchlorate, it has been proposed in U.S. Pat. No. 3,785,674 issued on Jan. 15, 1974 to Poole et al. to include a coolant chamber in the gas generator and to fill this chamber with a liquid halocarbon such as Freon® and to arrange for the halocarbon liquid to atomize in the nitrogen rich environment to reduce the temperature of the gas which is used to inflate the safety restraint (air bag). However, in this arrangement the gaseous combustion products are released directly into a chamber which contains the halocarbon liquid and which is closed by a burst disc. This of course, requires heating the liquid to its boiling point. The resulting mixture of gaseous freon and hot combustion products is reactive, and part of the freon decomposes. The decomposition of freon results in the formation of lower molecular weight halogen compounds (including HCl and HF), which are toxic. For this reason, freons are not used in hybrid air bag inflators.

U.S. Pat. No. 3,862,866 issued on Jan. 28, 1975 in the name of Timmerman et al. describes an arrangement which is essentially similar to the Poole et al. device, with the basic exception that water is used in place of halocarbon liquid. However, this arrangement is such that a slug of unvaporized liquid is apt to be shot out of the device only to result in the water being sprayed like a shower of rain throughout the interior of the air bag.

Thus, while these arrangements may find application as fire extinguishers of the nature disclosed in U.S. Pat. No. 5,449,041 issued on Sep. 12, 1995 in the name of Galbriath, wherein a solid propellant charge is ignited and used to drive a volume of liquid having flame suppressing capabilities, against a fire in a manner which suppresses and extinguishes it, they have failed to make the most efficient use of the cooling effect possible with the liquid used.

Another problem that these arrangements have failed to address is that of low temperature climates in which liquids, such as water, are apt to freeze and thus fail to achieve cooling of any degree, and/or even hinder the operation of the device by generating a block of solid material (ice) that is apt to either block the exits or turn into a missile which is fired out of the device in a highly undesirable manner.

The above problem is further aggravated in that the use of halocarbon liquids, which would tend to alleviate the freezing problem, are now severely restricted in light of various environmental considerations.

SUMMARY OF THE INVENTION

It is an object of the present invention to provide a gas generating device for air bags and the like, which achieves a fine atomization of a liquid coolant and which therefore achieves an efficient use thereof.

It is a further object of this invention to provide such a gas generating device which maintains the coolant liquid at a temperature above its freezing point and thus maintains the device properly operable irrespective of the climate in which the safety device associated with the gas generator is used.

In brief, the above objects are achieved by an arrangement wherein the combustion of a relatively small pyrotechnic charge is used to pressurize a chamber of water or other suitable type of liquid, and force it out of the chamber and through a conduit in a manner wherein it is caused to intimately mix and atomize in a high speed stream of gas resulting from the combustion of the charge. The sensible heat of the combustion products is absorbed by the water which is accordingly converted into a large volume of steam and water vapor. The mixture of vaporized water and combustion gas is used to inflate the air bag with an essentially non-toxic, low temperature, low particulate atmosphere.

More specifically, a first aspect of this invention resides in hybrid gas generator comprising: a housing having a closed chamber; a displaceable partition member disposed in the closed chamber and arranged to partition the closed chamber into first and second variable volume chambers; a non-flammable liquid disposed in the first variable volume chamber; a pyrotechnic charge disposed in the second variable volume chamber, the pyrotechnic charge being selectively ignitable to produce combustion gas and pressurize the second chamber in a manner which displaces the displaceable partition member in a direction which reduces the volume of the first variable volume chamber; means defining an orifice through which the combustion gas can vent from the second variable volume chamber; and passage means for transferring liquid from the first variable volume chamber and ejecting the liquid into the flow of gas from the second variable volume chamber at a location proximate the orifice.

A second aspect of the invention resides in a method which is characterized by disposing a liquid in a first chamber; disposing a pyrotechnic charge in a second chamber; separating the first and second chambers using a displaceable partition member; igniting the pyrotechnic charge to form combustion gas and to apply pressure to the displaceable partition member in a manner which forces the liquid out of the first chamber into passage means; and ejecting liquid from the passage means into a stream of combustion gas issuing from the second chamber by way of an orifice, in a manner which promotes heat exchange between the combustion gas and the liquid and which vaporizes the liquid.

BRIEF DESCRIPTION OF THE DRAWINGS

The various features and attendant advantages of the present invention will become more clearly appreciated as a description of the preferred embodiment is given in conjunction with the appended drawings wherein.

DETAILED DESCRIPTION OF THE PREFERRED EMBODIMENTS

Figure 1:
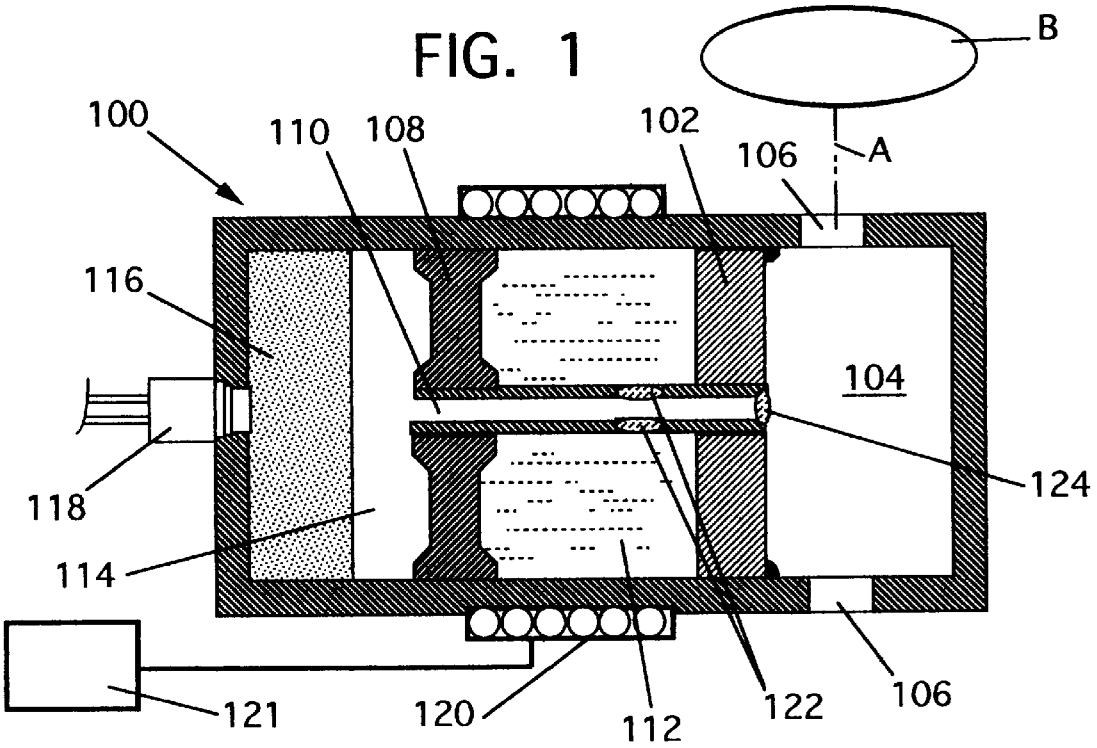
FIG. 1 is a cross-sectional view of a first embodiment of the invention.

FIG. 1 shows a first embodiment of the present invention. This embodiment comprises a housing 100 which is closed at both ends and which has a partition plate 102 disposed therein proximate one of its ends. The partition plate 102 is welded or otherwise fixed in position to divide the interior of the housing 100 into two sections. The smaller of the two sections 104 is formed with a plurality of substantially equally spaced, radial exhaust ports 106 which connect the interior of the smaller section 104 with a manifold A associated with an air bag B. The section 104 acts as flow diverter which induces turbulence and mixing; and results in thrust-neutral operation. If thrust neutrality is not a concern, the exhaust ports 106 need not be radial.

A piston 108 is slidably disposed in the larger section and arranged to slide along a hollow tube 110 which extends coaxially through the housing 100 and is rigidly supported in a through hole formed in the center of the partition plate 102. This piston and tube arrangement 108, 110 divides the larger section into two variable volume chambers 112, 114. Both the piston 108 and tube 110 are sealed to prevent mixing the contents of chambers 112 and 114 in storage. The first variable volume chamber 112 is, due to the provision of the tube 110, essentially a hollow cylinder, and is filled with a suitable liquid such as water. The second chamber 114 contains a pyrotechnic charge 116 which is so disposed as to be ignitable by a squib 118 that is mounted on the adjacent end of the housing 100.

A heating element 120 is disposed outside the housing in a surrounding relation to the first chamber 112 to selectively warm the liquid stored therein. The heating element could be located inside the housing, for example, integrally with the partition plate 102. The heating element can take the form of a thermostatically controlled electrical resistance heating element, or any other suitable form of heater which may be operatively connected with the engine exhaust or cooling system of a vehicle in a manner to have heat transferred thereto in the event that the ambient air temperature is low and the liquid (e.g. water) is apt to be frozen. In this embodiment, the heating element 120 is an electrical resistance type heater and is operatively connected with a thermostatic control means 121. As will be appreciated, if thermostatic feedback indicates the liquid is sufficiently cold as to be frozen, the heating element 120 will be activated to raise the temperature to a level where it can be assured that any ice that may have formed has melted and that the gas generating device is fully operational. The manner in which such heating and controlling can be implemented is well within the purview of a person skilled in the art of automotive safety (for example) and a detailed explanation will be omitted for brevity.

In order to hermetically seal the first variable volume chamber 112, small burst discs 122 are disposed in one or more radial ports which are formed in the wall of the tube 110 and which will, upon breaching, allow the liquid in the first chamber 112 to flow into the interior of the tube 110. Another small burst disc 124 is disposed in the end of the tube 110 which communicates with the smaller section 104.

With this arrangement, in the event that an ignition signal is transmitted to the squib 118, the resulting ignition of the pyrotechnic charge 116 produces a large volume of hot combustion gases which raises the pressure and temperature in the second variable volume chamber 114, pressurizing the piston 108 and the first variable volume chamber 112. Simultaneously, the combustion gases flow out of tube 110 after having burst the disc 124. The flow in tube 110 is approximately choked, so that the pressure is approximately half that in the chambers 114 and 112. Consequently, there is a driving force across the burst discs 122, causing them to fail, and causing flow from chamber 112 into the tube 110, when it mixes with the combustion gases and vaporizes. The resulting mixture exits tube 110 into chamber 104, where mixing and vaporizing are completed, and the equilibrium set of gases is then discharged from the housing through the orifices 106.

It is seen that the velocity of the gases passing through the tube 110 tends to produce a venturi effect which draws liquid out of the first variable volume chamber 112 which is under pressure because of the pressure in the second chamber 114 acting on the effective surface area of the piston 108, to ensure that the liquid is transferred out of the first chamber 112 and forced into intimate contact with the hot combustion gases in the tube 110. This contact, and the mixing that occurs in the flow diverting section 104, causes the liquid to absorb heat and to be vaporized to form a large volume of steam.

With the present invention, as the liquid is converted into steam the combustion products are greatly cooled and diluted. This reduces the amount of pyrotechnic charge which is necessary and the amounts of particulates which are present in the effluent. The resultant cooled effluent is clean enough for air bag inflation without the need for a filter.

It is noted that the piston 108 can be replaced with a flexible diaphragm such as a metal-coated polymeric film or corrugated metal foil diaphragm. This type of arrangement would of course eliminate possible leakage of water out of the first chamber 112 which would tend to occur with the passing of time, and would be more accommodating to possible freezing of the liquid.

The size of the first variable volume chamber 112 in which the liquid is stored is so dimensioned and arranged as to be able to contain, for example, all of the water at an elevated temperature of 107° F. and ice at −40° F. at respective densities 0.953 gm/cc and 0.962 gm/cc vs 0.997 gm/cc at 25° F. The lowest density is the design point. The device must be able to house hot water and to enable the formation of ice without damage to the various elements/structure of the device.

Preferably, the liquid is water, because it is nonreactive with the combustion products. Other suitable liquids are aqueous solutions of freezing point depressants, such as calcium chloride, or flame suppressants such as potassium carbonate.

Figure 2:
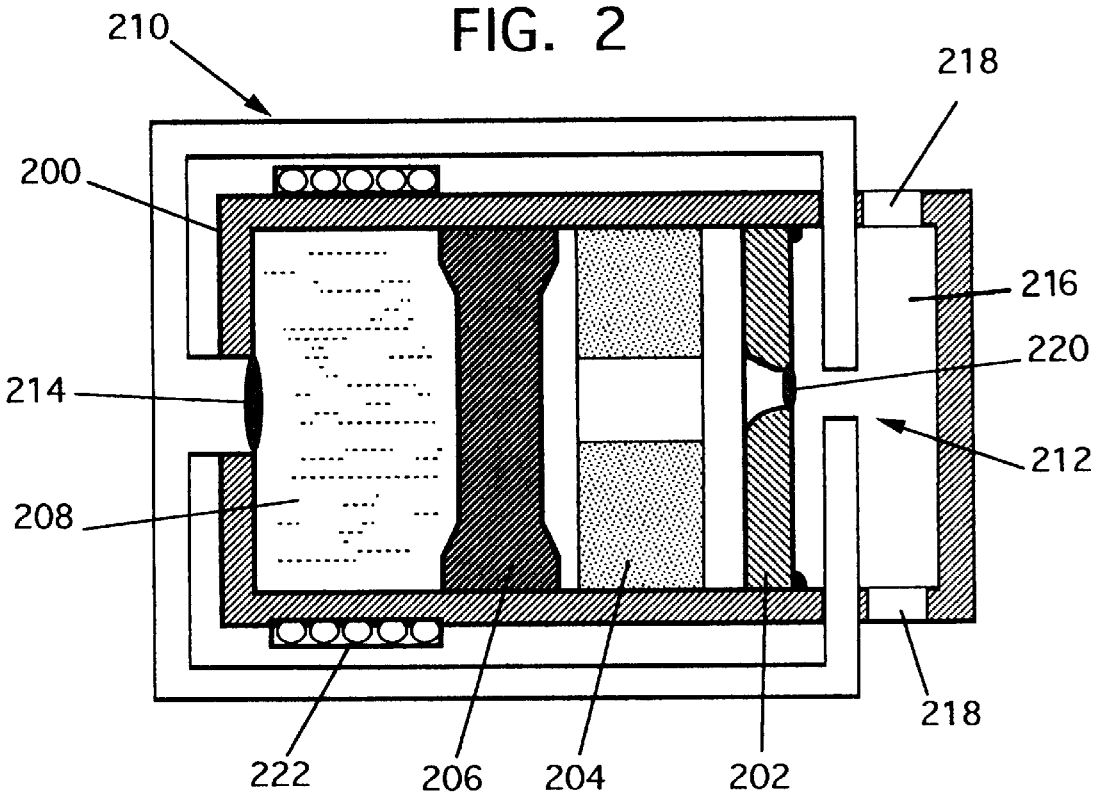
FIG. 2 is a cross-sectional view showing a second embodiment of the present invention.

FIG. 2 shows a second embodiment of the invention in which the housing 200 is partitioned by a baffle 202 which is welded or otherwise fixed in place and formed with an orifice in a manner to act as a sonic orifice plate. A pyrotechnic charge 204 is disposed in the housing 200 between the sonic orifice plate 202 and a piston 206. This pyrotechnic charge 204 may be ignited by any type of suitable ignition source (not shown) such as a squib similar to that illustrated in FIG. 1.

It will be noted that the piston 206 can be replaced with a suitable type of flexible diaphragm in the same manner as hereinbefore described.

A chamber 208, which contains a suitable liquid such as water, is connected via a passage generally denoted by the numeral 210 with a nozzle arrangement 212 which is located immediately adjacent the downstream side of the orifice formed in the sonic orifice plate 202 and in a position to be exposed to the flow of gases which are produced in response to ignition of the pyrotechnic charge 204. A second burst disc 220 is disposed in the orifice of the sonic orifice plate 202 to promote rapid ignition.

Communication between the chamber 208 and the passage 210 is cut-off by a first burst disc 214 which is constructed to breach upon a predetermined amount of pressure (e.g. hydrostatic pressure) being applied thereto.

A mixing or flow diverting chamber 216 into which the combustion products and liquid are injected during operation, is connected with a manifold and air bag (not shown), by exit ports 218. The nozzle arrangement 218 can comprise a plurality (e.g. 10) of circumferentially arranged, substantially equidistantly spaced spray nozzles for thrust neutrality. If thrust neutrality is not required, then the nozzles 218 need not be equally spaced circumferentially.

A thermostatically controlled heating element 222 is disposed about the housing 200 in a manner to selectively warm the liquid in chamber 208 if the ambient temperature is below the freezing point, and formation of ice is possible and/or has occurred during periods of non-use. As previously described, if the liquid has frozen, the heating element 222 is operated for a given period of time to melt any ice before the gas generating device is rendered fully operational.

The operation of this embodiment is essentially similar to the first one and is such that upon ignition of the pyrotechnic charge 204, the combustion gas pressure acting on the piston 206 will drive it toward the burst disc 214 and create a hydrostatic pressure in chamber 208 sufficient to breach the disc. This, of course, permits liquid to flow through the passage 210 to the nozzle arrangement 212 and to be entrained in a high speed flow of combustion gases which have breached the second burst disc 220 and which are emitted via the orifice in the sonic orifice plate 202. Due to the high speed fluid flows, the liquid becomes highly atomized and mixes with the hot combustion gases in the mixing chamber 216 in a manner which causes the formation of steam and reduces the temperature of the hot combustion gases.

It should be noted that, while a multi-passage passage structure 210 has been illustrated in FIG. 2, a single passage may be sufficient if it is suitably dimensioned and arranged to direct a jet of water into contact with the high speed flow of combustion gas which is emitted from the orifice in the sonic orifice plate. By way of example only, directing the jet of water directly toward the orifice so as to meet the flow of hot exhaust gases head on, is within the scope of the present invention.

As in the embodiment shown in FIG. 1, the various elements of the embodiment shown in FIG. 2 are dimensioned so that the driving pressure, which is applied to the water, is about ½ of the combustion gas pressure and results in the water being injected into the flow of combustion gases in a manner wherein suitable mixing of the water and gases is achieved. Further, the total flow area of all of the orifices 218 in the mixing and flow diverter chamber 216 is large enough to ensure a choked flow at the sonic orifice plate 202, and the volume of the chamber 216 is large enough to ensure complete vaporization of the liquid.

Figure 3:
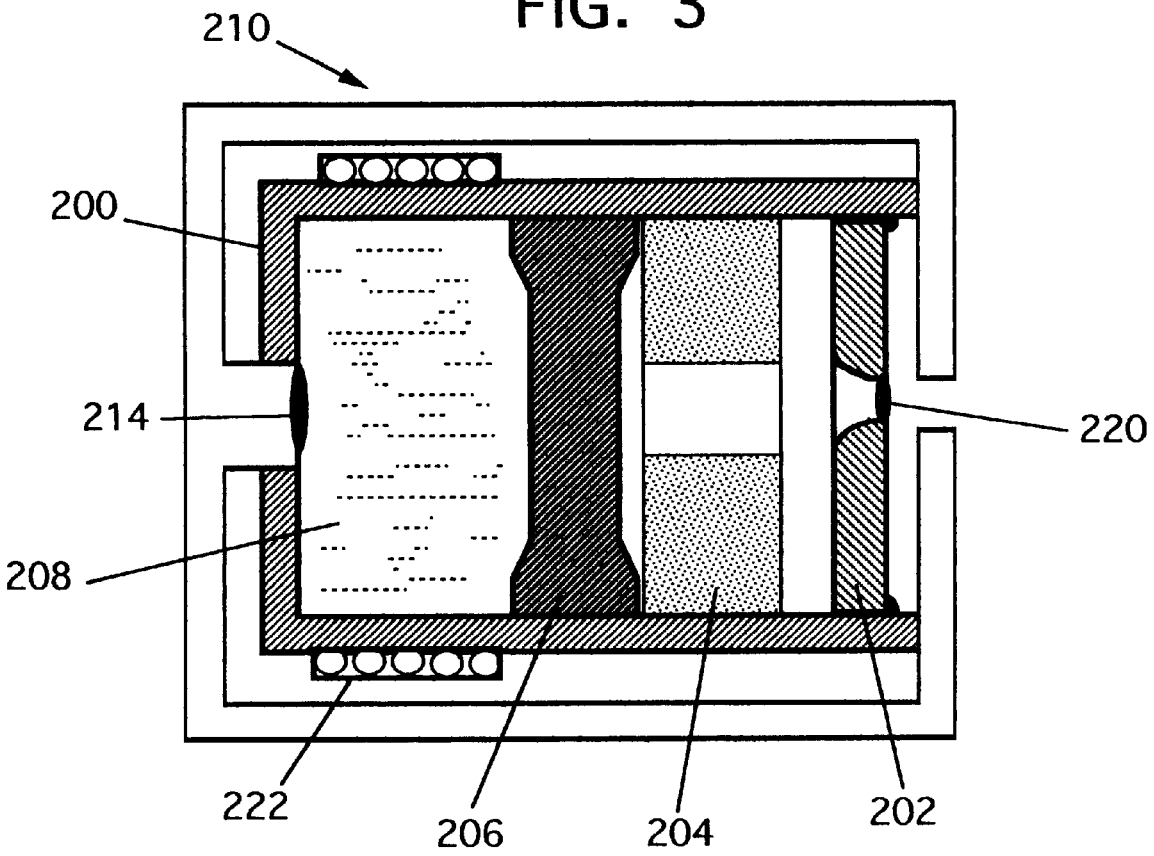
FIG. 3 is a cross-sectional view of a variant of the second embodiment which is adapted for use as a fire extinguisher.

FIG. 3 shows a further embodiment which has been adapted for use as a fire extinguisher. As will be noted, this embodiment is structurally similar to the second embodiment in FIG. 2 and differs in that the mixing and flow diverter chamber has been omitted, with the result that the mist/spray which will result from the mixing of the liquid and combustion gas flows, will be ejected axially without impediment. In order to increase the velocity and direction with which the mist of liquid, steam and combustion gas, are jetted toward a fire or the like, it is within the scope of this invention to modify the nozzle design so that the liquid is ejected at least in part in a direction substantially parallel to the flow of combustion gas issuing from the orifice in the sonic orifice plate 202. This is a way to blow out the flame, as well as extinguish it. As will be appreciated, in this type of application, it may actually be preferable in some cases to allow a portion of the liquid to arrive at the target in the form of droplets which have not yet been atomized and which can achieve a wetting effect. As noted previously, the liquid may be water, or an aqueous solution of a flame suppressant such as potassium carbonate or a flame retardant such as halogenated and phosphorated organic acids and alcohols.

Although this invention has been disclosed with reference to only three embodiments, the various changes and modifications which can be made without departing from the scope of protection will be self-evident to those skilled in the art to which the present invention pertains. That is to say, while the invention has been described as using water or another suitable type of non-toxic aqueous solution, the use of environmentally friendly halocarbons or similar liquids is possible, should they be shown to be nontoxic in the preferred applications. This is especially the case in fire extinguishing applications wherein it is necessary to very rapidly fill a space with a breathable atmosphere through which flames will not propagate, such as in passenger aircraft for example.

What is claimed is:

1. A hybrid gas generator comprising:

a housing having a closed section;

a displaceable partition member disposed in the closed section and arranged to partition the closed section into first and second variable volume chambers;

a non-flammable liquid disposed in the first variable volume chamber;

a pyrotechnic charge disposed in the second variable volume chamber, said pyrotechnic charge being selectively ignitable to produce combustion gas and pressurize the second chamber in a manner which displaces the displaceable partition member in a direction which reduces the volume of the first variable volume chamber;

means defining an orifice through which the combustion gas vents from the second variable volume chamber; and passage means for transferring liquid from the first variable volume chamber and ejecting it into the flow of gas from the second variable volume chamber at a location proximate said orifice prior to venting the combustion gas through said orifice.

2. A hybrid gas generator as set forth in claim 1, further comprising flow diverter means for diverting the flow of gas passing through the orifice and the liquid ejected from the first variable volume chamber to cause the gas and the liquid to mix and the heat content of the gas to be imparted to the liquid to vaporize it.

3. A hybrid gas generator as set forth in claim 2, wherein the flow diverter means comprises a mixing chamber in said housing having exit ports.

4. A hybrid gas generator as set forth in claim 3, further comprising a manifold in fluid communication with said exit ports and an inflatable safety restraint device which is connected with the manifold in a manner to be inflated by the gas and vapor emitted from said mixing chamber.

5. A hybrid gas generator as set forth in claim 4, wherein said mixing chamber and said orifice are so sized as to cooperate in a manner wherein choked flow at said orifice and the volume of said chamber causes essentially complete vaporization of the liquid.

6. A hybrid gas generator as set forth in claim 1, further comprising a first burst disc which closes the orifice, the first burst disc being set to breach and to open the orifice when a predetermined pressure develops in said second variable volume chamber as a result of the combustion of the pyrotechnic charge.

7. A hybrid gas generator as set forth in claim 6, wherein said passage means comprises a tube having a first end opening into said second variable volume chamber and a second end disposed in said orifice, said tube having a port which communicates with said first variable volume chamber and which is closed by a second burst disc that is set to breach when a predetermined hydrostatic pressure develops in said first variable volume chamber.

8. A hybrid gas generator as set forth in claim 1, wherein a port, which communicates said first variable volume chamber with said passage means is closed by a burst disc that is set to breach when a predetermined hydrostatic pressure develops in said first variable volume chamber.

9. A hybrid gas generator as set forth in claim 1, wherein said displaceable member is a piston which is reciprocally disposed within the closed chamber of said housing.

10. A hybrid gas generator as set forth in claim 1, further comprising a heater disposed in a vicinity of said first variable volume chamber, said heater selectively heating the liquid in said first variable volume chamber.

11. A hybrid gas generator as set forth in claim 10, wherein said heater is thermostatically controlled.

12. A method of generating gas comprising the steps of:

disposing a liquid in a first chamber in a housing;

disposing a pyrotechnic charge in a second chamber in the housing;

separating the first and second chambers with a displaceable partition member;

igniting the pyrotechnic charge to form combustion gas and to apply pressure to the displaceable partition member in a manner which forces the liquid out of the first chamber into passage means associated with the housing; and ejecting the liquid into a stream of combustion gas issuing from the second chamber in the passage means in a manner which promotes heat exchange between the combustion gas and the liquid and which vaporizes the liquid.

13. A method as set forth in claim 12, further comprising the step of deflecting the flow of combustion gas and liquid into a mixing chamber to promote mixing and heat exchange between the combustion gas and the liquid and the conversion of the liquid into vapor.

14. A method as set forth in claim 12, further comprising the step of closing the passage means using a first burst disc which is set to breach when the pyrotechnic charge is ignited and the gas pressure in said second chamber exceeds a predetermined level.

15. A method as set forth in claim 12, further comprising the step of using the passage means to conduct liquid from the first chamber to an exit orifice and cutting-off communication between the first chamber and the passage means using a burst disc that is set to burst when the pressure in the first chamber reaches a predetermined level.

16. A method as set forth in claim 12, further comprising the steps of:

monitoring the temperature of the liquid; and selectively heating the liquid in the first chamber in the event that the temperature is below a predetermined level.

* * * * *